US006559758B2

(12) United States Patent
Rey

(10) Patent No.: US 6,559,758 B2
(45) Date of Patent: May 6, 2003

(54) MULTI-TONE WARNING SOUNDER

(76) Inventor: Charles Rey, 1332 Woodland La., Riverwoods, IL (US) 60015

( * ) Notice: Subject to any disclaimer, the term of this patent is extended or adjusted under 35 U.S.C. 154(b) by 103 days.

(21) Appl. No.: 09/899,470

(22) Filed: Jul. 5, 2001

(65) Prior Publication Data

US 2003/0006885 A1 Jan. 9, 2003

(51) Int. Cl.[7] ..... G08B 3/10

(52) U.S. Cl. ..... 340/384.6; 340/384.1; 340/384.7; 340/384.72; 386/63; 386/85

(58) Field of Search ..... 340/384.6, 384.1, 340/384.7, 384.72; 968/968; 368/63, 85

(56) References Cited

U.S. PATENT DOCUMENTS 4,097,694 A * 6/1978 Miyazaki
4,186,371 A * 1/1979 Toubkin et al. ..... 367/109
4,397,562 A * 8/1983 Shirasu ..... 368/63

* cited by examiner

*Primary Examiner*—Julie Lieu
(74) *Attorney, Agent, or Firm*—Pyle & Piontek

(57) ABSTRACT

A sounder device includes a piezoelectric resonant transducer, an amplifier and a coupling transformer to drive the transducer, an electronic signal produced to provide an input signal to the amplifier, and in which the electronic signal producer includes at least two lower frequency oscillators, a logical "OR" circuit having inputs from each of the lower frequency pulse oscillators, a resonant frequency pulse oscillator having a higher frequency near the resonant frequency of the transducer, a logical "AND" circuit having a first input connected to the output of the logical "OR" circuit, a second input connected to the output of the resonant frequency oscillator, and having an output connected to the amplifier input.

11 Claims, 8 Drawing Sheets

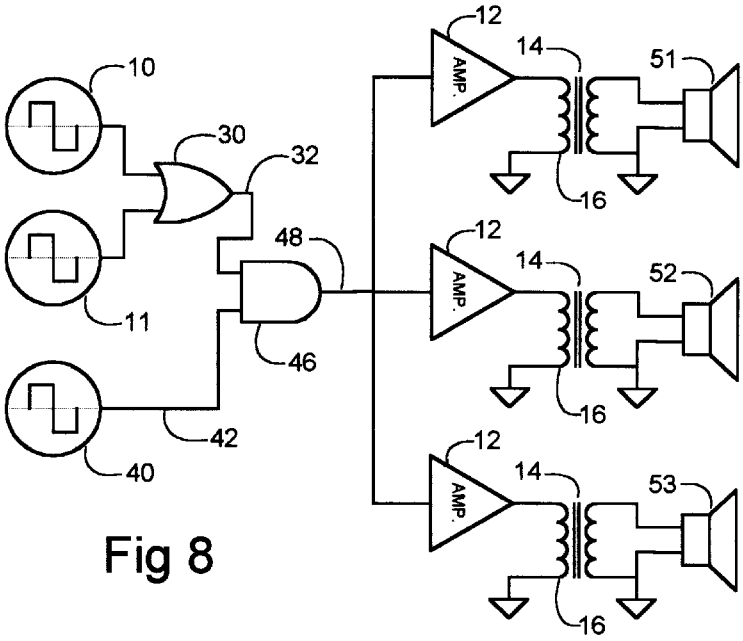
Fig 8
Fig 9
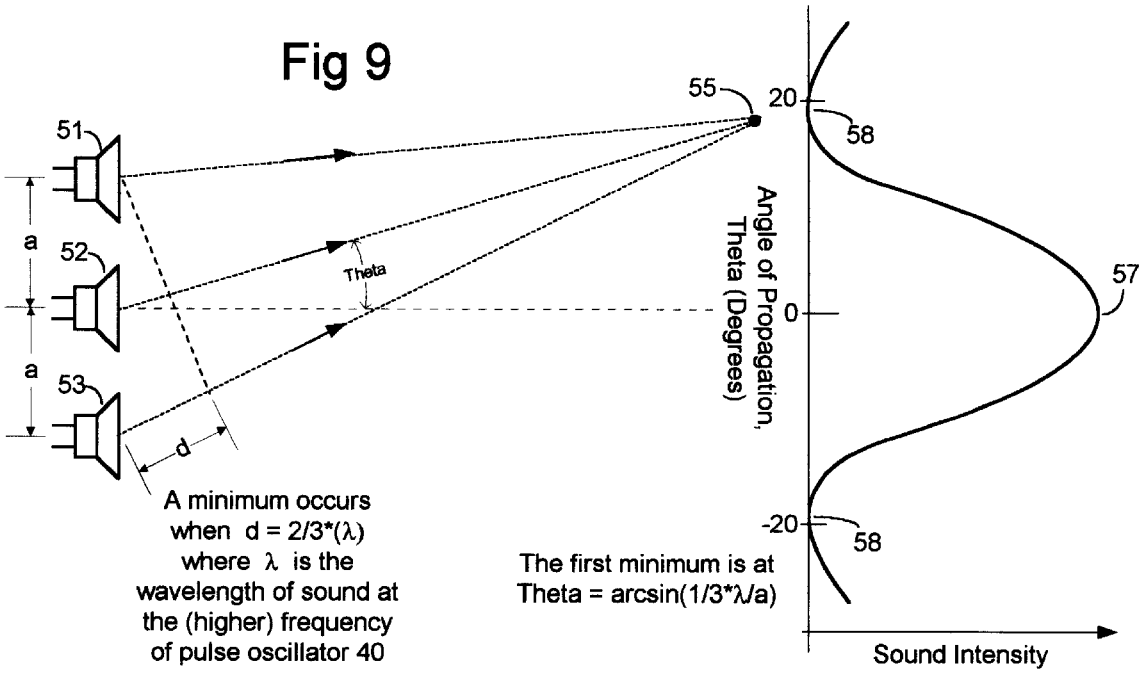

MULTI-TONE WARNING SOUNDER

BACKGROUND OF THE INVENTION AND PRIOR ART

This invention relates generally to audible warning devices such as automobile or boat horns, and other acoustic signaling devices. Usually these sounder devices are designed to be as small as possible and use as little electrical power as possible, but nevertheless must be capable of producing a high intensity acoustic output. There are many designs in prior art which have proven useful with some desirable features. These include the generation of perceived intense sound of more than one frequency occurring simultaneously, as discussed in U.S. Pat. No. 4,303,908 (Enemark), with the frequency differences being non harmonically related, as in U.S. Pat. Nos. 4,204,200 (Beyl) and 4,689,609 (Ko), or using combinations of arbitrary frequencies in order to make more alarming or raucous sounds. However, sounders with the above capabilities, and which also can produce very high acoustic peak pressure levels with very high efficiencies have not been optimally addressed by prior art.

In order to obtain high efficiencies many such devices use transducer elements of a piezoelectric nature as in U.S. Pat. Nos. 3,912,952 (Kumon) and 5,990,797 (Zlotchenko). These are usually resonant at some relatively high frequency, typically 2 to 4 kHz. However at these frequencies, the sound does not have the desired warning urgency characteristic that lower frequency sounders can produce.

A major problem of prior art is obtaining alarming lower frequency sounds while using highly efficient resonant transducers. This goal has been addressed in prior art with some success by using resonant transducers and frequency modulating their output to produce an effect similar to an emergency vehicle siren as in U.S. Pat. Nos. 4,088,995 (Paladino) and 4,195,284 (Hampshire), or by amplitude modulating their higher resonant frequency with a lower frequency as disclosed in U.S. Pat. No. 4,486,742 (Kudo). This produces a perceived sound of the lower frequency and the human ear seems to be mostly unaware of the higher carrier frequency. However, in prior art there seemed to be no highly efficient solution using this approach. This invention addresses this problem by optimizing the electrical drive going to the transducer to simultaneously best take advantage of the resonant nature of the transducer and yet deliver an audible and discernable lower set of frequencies for warning or signaling purposes.

A second problem is getting the sound to propagate primarily in a preferred direction and yet not require very large radiating surface dimensions, so that the directed acoustic energy of the source is concentrated in a defined angular range. It is well known that the angular radiation pattern of a sound source is controlled by the transverse dimensions of the source relative to the wavelength of the sound. In order to confine the radiation to a specific angle the transducer dimensions transverse to the propagation direction must be at least as large as about half the wave length of the sound being generated. So, for example, a directed sound of 300 Hz of wave length about 1 meter would require a radiator of about a half meter or more across. However a frequency of 3 kHz would only require a transducer of about 5 cm diameter. This invention attains the goal of lower frequency perception, but within the angular range set by the higher resonant frequency of a small, very efficient resonant transducer, or as will be described, by an array of such transducers.

SUMMARY OF THE INVENTION

A principal object of the invention is to provide a method for producing a very high intensity warning sound from an efficient and compact device which uses higher frequency resonant transducers.

Another object of the invention is to provide a warning device which has two or more frequencies which resemble conventional automobile horns or similar devices, but which utilize the high efficiencies of resonant transducers which have resonances at much higher frequencies.

A further object of the invention is to provide a method for controlling the direction of the radiated sound from a warning device consistent with the shorter wavelength of the higher resonant frequencies, while still producing sounds at the lower frequencies with longer wavelengths.

The first and second objectives are accomplished by the following approaches. As with prior or related art an electrical signal from an oscillator with a relatively low frequency, typically about 100 to 500 Hz, is amplified by a transistor means and then the voltage of this signal is increased by a step up transformer, with its output then applied to a piezo-electric sound transducer element. Typically the oscillator in prior art has been a simple "square wave" digital logic level source, i.e. one which is on for the same duration as it is off. This then produces current flow through the transistor or other amplifier means to the transformer primary winding for 50% of the period of the oscillator. The transformer secondary winding then sends current to the piezoelectric element which is primarily a capacitive load element C. Because the transformer secondary is also an inductor with inductance L, it forms, with the capacitive transducer, a simple tank circuit with a natural frequency $f_{RES}$ given by:

$$f_{RES}=(2*\pi*\sqrt{(L*C)})^{-1} \quad (1)$$

which in this invention is preferably best tuned to the about the same frequency as the primary natural mechanical resonant frequency of the transducer, which in many cases is from about 2 to 4 kHz. In any case, whether or not so tuned, when the square wave signal from the transistor is switched from the off to the conducting or on state, the secondary winding and the transducer will electrically start to "ring" or oscillate at the effective fundamental resonant frequency. However, at the moment when the transistor turns off, the transformer secondary voltage applied to the piezoelectric transducer abruptly reverses and the force on the transducer is reversed relative to when the voltage was first applied. The resulting effects on the amplitude of the motion of the transducer's radiating element can vary widely, for if it comes at the wrong time, it can slow, stop, reverse, or decrease the amplitude of the motion and hence impair the acoustic output. If it occurs at the ideal time it will significantly enhance the output.

It is an important part of this invention to replace the "square wave" oscillator with a rectangular pulse oscillator, i.e. one with a pulse with an independently adjustable "on" duration, which is independent of the "off" duration and hence is independent of the oscillator frequency. The time that the pulse is "on", or the "on width", is adjusted such that the end of the conducting period occurs at the time when the motion can best be increased in the direction it is already moving. This is analogous to first pushing a person in a swing, and then as the swing reverses direction pushing the swing back in the opposite direction to increase the range or amplitude of motion. So it is with the reverse voltage applied to the transducer. It must be timed optimally, or in other words, have the correct phase relationship to the already occurring oscillating transducer motion. The pulse generating oscillator is adjusted to have the optimum pulse "on width" which maximizes the motion of the transducer element. The benefit of this is to increase the peak acoustic amplitude output of the transducer.

An additional benefit is that in general the duration of the pulse is shorter than in the square wave case, so that less power is consumed. For example if the lower frequency is 300 Hz, with a period of 3.33 msec, and the resonant frequency is 2000 Hz, with a period of 0.50 msec, then the square wave pulse would have been on for one half of 3.33 msec or 1.67 msec, while in the improved case the "on width" of the pulse is best set on the order of about half of 0.50, or 0.25 msec. In such circuits which use a coupling transformer, the power supply current flow continues to increase during the on time of the transistor and so the power savings can be substantial.

A second part of this invention is to utilize more than one arbitrary lower frequency by adding, in a conventional logical "OR" circuit, the output of two or more such oscillators, each with its own proper pulse width thus providing the optimum phase at turn off of each pulse to best enhance the motion of the transducer. This efficiently creates high output peak intensities but with the perceived sounds of the multiple lower frequencies. These multiple frequencies can be arbitrary, are not constrained by any harmonic relations nor are they dependent on the resonant frequency of the transducer. In fact, they may be chosen or tuned to be harmonically pleasing, or conversely may be discordant or comprised of some combinations which produce beat frequency effects that are advantageous for attention getting or even animal control purposes.

A third part of this invention uses the same principles as relied upon in the first two parts, but adds a plurality of pulses of the optimum pulse width from a resonant (higher) frequency pulse oscillator, gated on during the duration of the on time of the pulses from each of the lower frequency pulse oscillators. These multiple pulses are preferably timed to occur at the resonant frequency of the transducer, so that their phase relationship to the motion of the transducer is optimized. This last improvement is obtained in one embodiment by first mixing the lower frequency signals in a conventional digital "OR" circuit and then, in a digital "AND" circuit, combining the "OR" output signal with a pulse train from an oscillator of frequency near, or at, the resonant (higher) frequency of the transducer, with its on pulse widths optimized as previously described. In this case the resonant (higher) frequency pulse train is synchronously applied to the transducer in bursts with a burst duration of controlled length, and at the repetition rates of the lower frequencies. The main advantage of this configuration is an increased efficiency and higher peak output levels for a given size transducer. An added characteristic is that the spatial distribution of the radiated sound is governed by the higher frequency of the resonance and yet the perceived sound is at the lower frequencies. This last characteristic then is put to use in addressing the final objective of this disclosure as follows.

Finally, using the circuit last described, the synchronized signal with the proper phase can be sent to more than one transducer and these transducers can be arranged in various patterns, so that the angular distribution of the acoustic radiation will follow the well known laws for diffraction and interference, with the controlling wavelength corresponding to the higher resonant frequency, while the sounds will be heard at the lower frequencies. Surprisingly but understandably, the lower frequencies do not themselves have any appreciable effect on the radiation pattern. Thus the resonant frequency wavelength can be exploited to control the directivity of the transducer or that of an array of such transducers.

A final variation of this invention is to use multiple transducers with varying phase shifts or signal delays to different transducers, in order to electronically control the direction of the radiated lower pitch sound, but with the agility of the higher frequency and shorter wavelength corresponding to the transducer's resonance.

BRIEF DESCRIPTION OF THE DRAWINGS

These and other objects and advantages of the invention will be apparent upon reading the following description in conjunction with the drawings in which:

FIGS. 2(*a, c, d, e*) reflect prior art, and FIGS. 2(*b, f, g, h*), relate to an improvement in accordance with this invention, whereby the efficiency is enhanced by using the resonant gain of a higher frequency resonant transducer, while producing a lower frequency sound.

FIG. 8 describes another embodiment in which more than one transducer receives the same synchronized higher frequency pulse group which controls the angular distribution of the radiated sound.

FIG. 9 illustrates an example of the angular distribution of the arrangement of FIG. 8.

DESCRIPTION OF THE PREFERRED EMBODIMENTS

Figure 1:
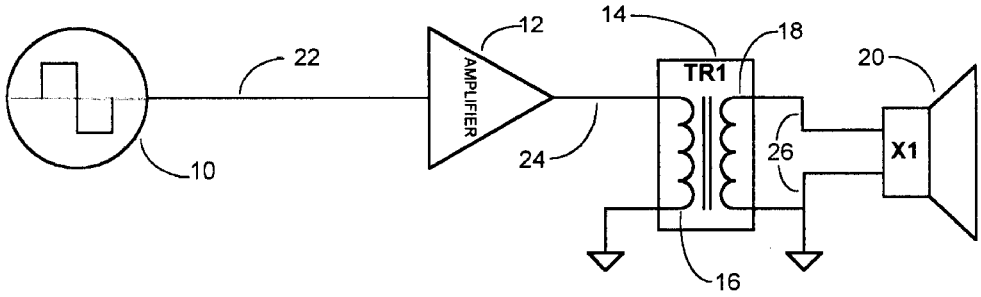
FIG. 1 depicts a commonly used prior art arrangement, with one square wave oscillator, an amplifier and transformer means feeding a series of square waves to a resonant transducer.

FIG. 1 illustrates a representative prior art device. Oscillator 10 produces a square wave output at 22 which is on or off for the same duration. This signal is amplified by a switching amplifier 12 and the resulting on or off signal 24 is sent to a transformer means 14 which provides a proper impedance match to the transducer 20. The current from the amplifier 12, flows only during the "on" part of each oscillator cycle into the primary 16 of transformer TR1. The secondary 18 is connected to the transducer 20, which may be electromagnetic, piezoelectric, or otherwise.

Figure 2:
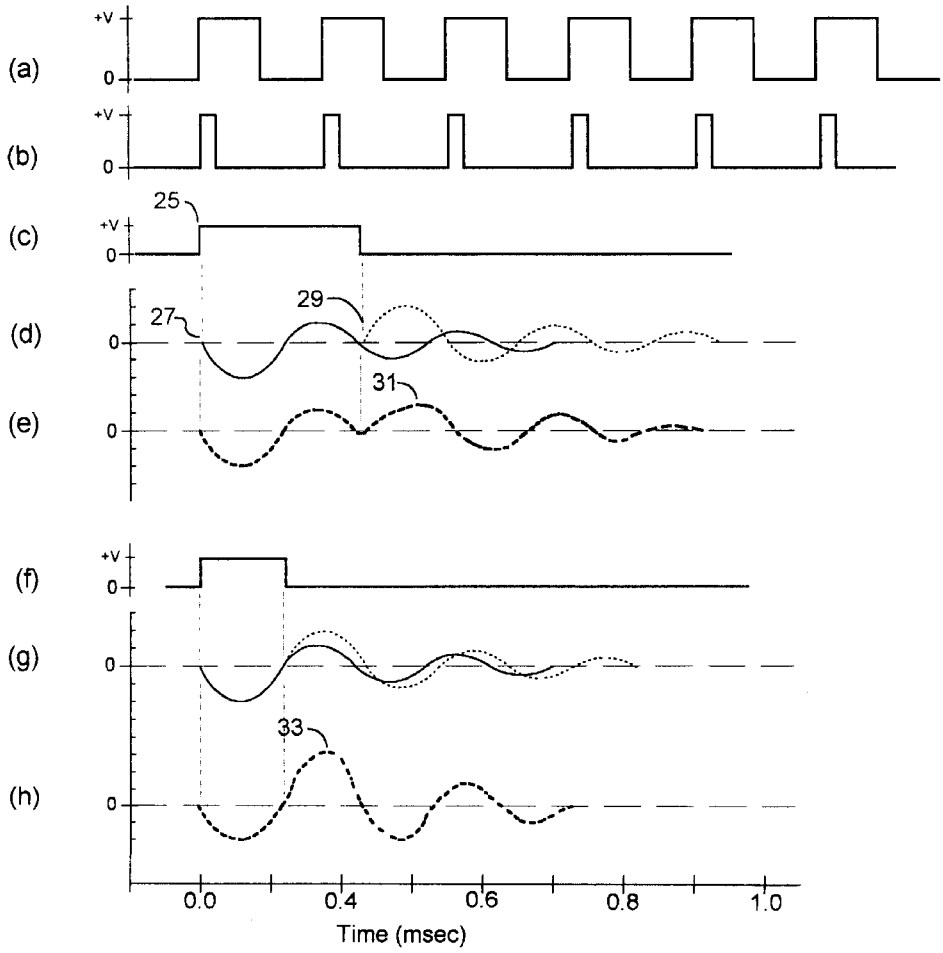
FIG. 2 depicts the wave forms at various points in the arrangement of FIG. 1.

In FIG. 2, the waveforms are shown for the various conditions and points shown in FIG. 1, in order to understand one of the improvements of this invention. In the case of prior art FIG. 2*a* depicts the square wave as it would appear on wire 22 and would indicate when in the higher state that current would flow from amplifier 12 through 24 and the primary 16 of TR1 14. This arrangement is often used with a resonant transducer, usually a piezoelectric element on a thin diaphragm which flexes readily in at least one fundamental mode. In this case the transformer is a step up device with the secondary 18 having a relatively high self inductance, and providing to the transducer a higher operating voltage than is typically available from the power supplied to the amplifier 12.

One improvement of this invention is to use an optimum pulse width which is illustrated in FIG. 2*b*. In order to understand how this pulse width is best determined we refer to FIGS. 2*c* through 2*h*, with expanded time scales.

The piezoelectric element 20 in FIG. 1 is primarily a capacitive load which is in parallel with the transformer secondary 18, and thus forms a tank circuit, with a resonant frequency $f_{RES}$. This tank circuit is excited by the start of the "on" pulse from the current flow in TR1 14, shown at point 25 in FIG. 2*c* with an expanded time scale. The ringing voltage across the connections 26 of this circuit is represented in FIGS. 2*d* and 2*e*. At the time the current pulse starts, i.e. at the point 25 in 2*c*, the solid line in FIG. 2*d*, shows the natural ringing starts at 27 with a typical damping of amplitude with time, with the voltage approaching zero for long enough times. However when the current pulse turns off, the corresponding point 29 is the start of another damped sine wave shown as a dotted line starting at 29 and decaying in amplitude (although in general may be less damped than before because the output of the amplifier is in the off state and the primary is open circuited). The dashed curve in FIG. 2*d* represents the combined amplitudes of the ringing effects from the turn on and turn off of the amplifier and the resulting peak amplitude at point 31. Because of the wide variation of resonant frequencies of the tank circuit between the on and off conditions of the amplifier, the timing of the turn off part of the amplifier pulse in prior art, rarely occurs at an optimum time to produce the maximum voltage signal to the transducer.

Demonstrating an element of this invention and referring to FIGS. 2*f* to 2*h*, an optimized pulse width is shown with the same ringing frequencies as in FIGS. 2*c* to 2*e*. The solid and dotted curves show the ringing in this case, and combine amplitudes with a much larger peak amplitude at 33 than there was at point 31, and hence produce a correspondingly greater acoustic output from the transducer.

Figure 3:
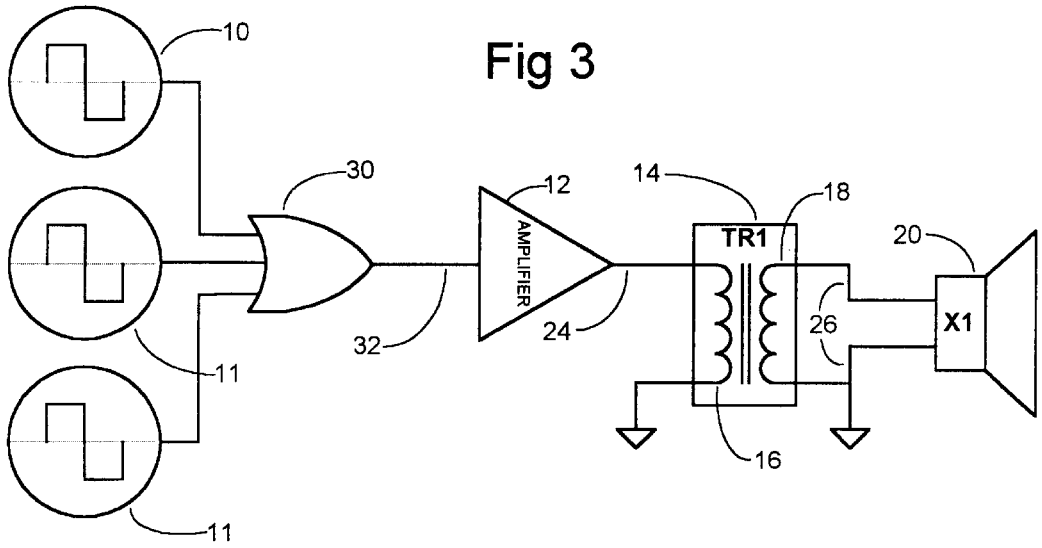
FIG. 3 illustrates a modification of FIG. 1 that is constructed in accordance with the invention to simultaneously provide more than one lower frequency to a single transducer, which is resonant at a higher frequency.

Referring to FIG. 3, similar elements bear the same reference characters and perform substantially the same functions as in FIG. 1.

There are two or more lower frequencies. The first low frequency signal is generated by a simple rectangular pulse oscillator 10, and additional frequencies by one or more similar pulse oscillators 11. The oscillator outputs are combined in the logical "OR" circuit 30 with output on 32 which connects to amplifier 12 as in FIG. 1. Note that the individual outputs of these pulse oscillators all preferably have pulse widths which are optimized for the transformer 14 and transducer 20 combination. These lower frequencies are arbitrary and need not have any harmonic relationship to each other or to the resonant frequency of the transducer. Therefore these frequencies may be varied in frequency for siren-like effects, or varied in duration (i.e. pulsed on and off at 0.5 to 10 Hz rates for example) for attention getting effects.

Figure 4:
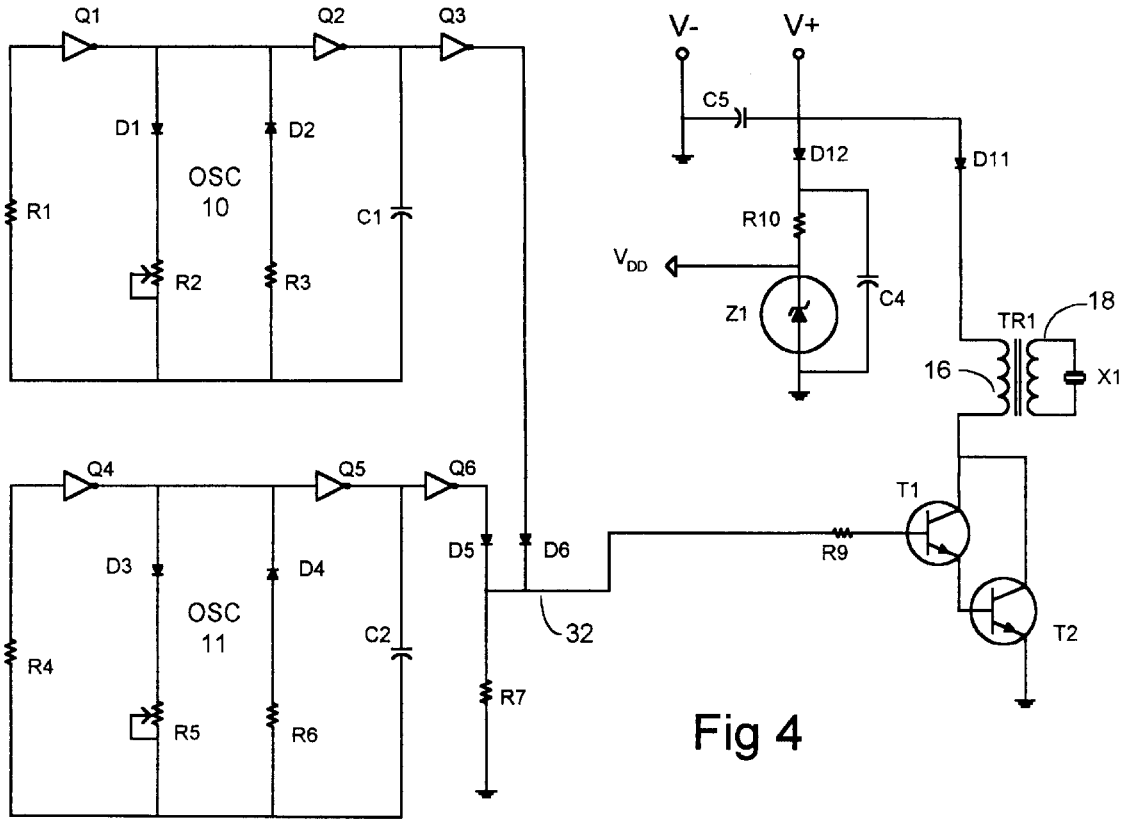
FIG. 4 is a detailed circuit diagram which depicts one way in which the arrangement of FIG. 3 may be realized for the case of two lower frequency pulse oscillators using a common hex inverter integrated circuit and other commonly available components.

In FIG. 4, a practical circuit diagram for realizing one configuration of the arrangement of FIG. 3 is described. In this figure there are two pulse oscillators 10 and 11. The first uses a common "cmos" hex inverter integrated circuit, with Q1 and Q2 forming a digital pulse oscillator with on time or pulse width dependent on the product of capacitor C1 and resistor R2, which is in series with diode D1. R2, which may be adjustable is only relevant when the output of Q1 is high so that current flows to charge C1, until Q1 is turned off and its output goes to the low state. Then the diode D2 turns on and the off time depends only on the product of C1 and R3 which is series with D2. The output of Q2 goes to Q3 which acts as an inverting buffer to lessen any load related cross coupling of another oscillator output.

The combination of D5, D6 and R7 form a logical OR with output at 32. The output of Q3 is connected to diode D6 and then combined with another similar pulse oscillator output from Q6 through diode D5 at 32. The point 32 is connected to ground by resistor R7 and to the R9 and then to the base of a darlington transistor pair T1 and T2. During the on part of the pulse the current will flow through the primary of TR1 from diode D11 connected to the power source V+. The diode D11 protects against reverse polarity application across the input terminals, V+ and V−. The secondary 18 of TR1 is connected directly to the transducer X1.

Oscillator locking, where two nearby frequencies synchronize with each other giving only one discreet frequency out, can occur if the effective impedance of the power source is high enough to allow a significant voltage drop at V+ during the on time of T1 and T2. A further refinement of this invention is the oscillator power supply regulating circuit means, shown in FIG. 4. This is designed to dynamically isolate the power supplied to the oscillator circuitry in order to prevent this unwanted oscillator locking. Power is applied to the $V_{DD}$ pin on hex inverter (Q1 through Q6) from the voltage regulator C4, R10, and Z1. If during the time that T2 is conducting a large current, the voltage at V+ drops too low the diode D12 becomes non-conductive and C4 continues to supply sufficient current to $V_{DD}$ and Z1 through R10 to maintain oscillator stability.

Figure 5:
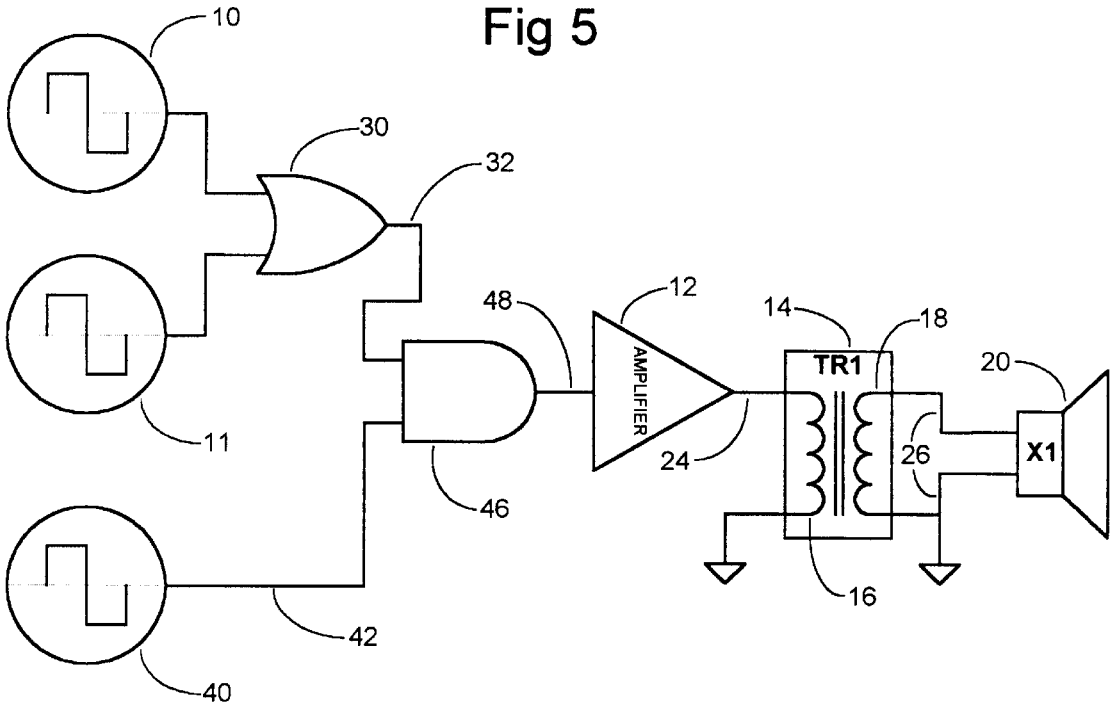
FIG. 5 is a block diagram which illustrates another preferred embodiment of the invention in which a group of pulses at the higher resonant frequency, is sent to the transducer during the "on pulse" for each of the lower frequencies.

In FIG. 5 we describe the preferred embodiment of this invention. The lower audio frequencies are generated by one or more pulse oscillators as previously described in FIG. 3, represented here by oscillator 10 and some number of other oscillators 11. The pulse width or on time of each oscillator 10 and 11, is made long enough in this case, so that more than one pulse from oscillator 40 can occur during the high state of output 32, and in general, this "on time" is less than half the period of the lower frequency oscillator.

These signals are combined as before in the logical "OR" 30, and the resulting "OR" output pulses on 32 are sent to a first input of the logical "AND" 46. Oscillator 40 generates a pulsed signal with a higher frequency, at or near the resonant frequency of the transducer, and has its pulse width optimized to give the highest acoustic output. That is, the turn off time of the pulse and its subsequent ringing of the tank circuit, is set to coincide most favorably with the turn on induced part of the ringing, as was described in the discussion of FIGS. 2 and 4. This oscillator's pulse output 42 is applied to a second input of the logic AND 46, and the resulting output of 46 is sent by 48 to the amplifier 12. The resulting lower frequency bursts of higher resonant frequency oscillator 40 pulses are amplified and drive the transducer as before.

Figure 6:
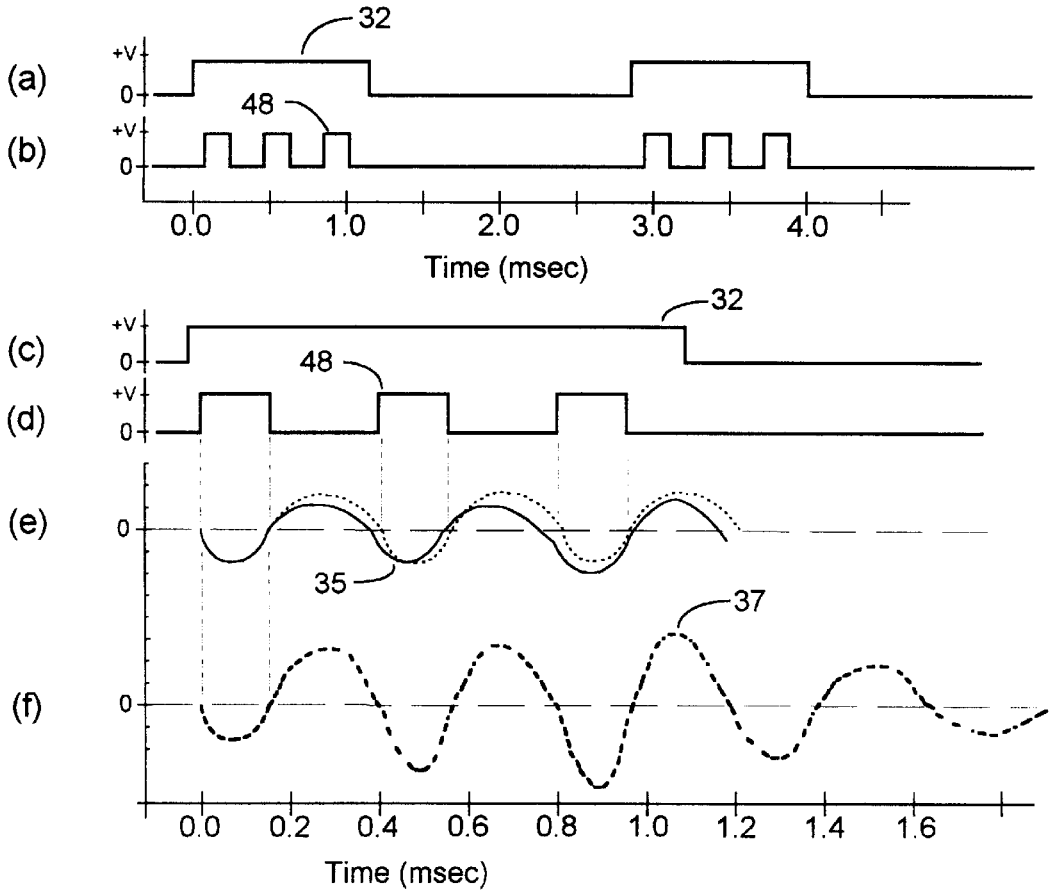
FIG. 6 illustrates the signals and wave forms that are related to the arrangement of FIG. 5.

In FIG. 6 the pulse and wave shapes found in the arrangement of FIG. 5 are described. In 6*a*, the signals from one of a plurality of lower frequency pulse oscillators, such as 11 in FIG. 5, is shown. The pulse 32 is no longer set to an optimum pulse width, but is made long enough so that more than one pulse from oscillator 40 can occur during the high state of 32.

The signal at 32 may be on long enough that many pulses occur during the on time, but in general, the on time is less than half the period of the lower frequency oscillator. After being combined with the higher frequency pulses from oscillator 40 in the AND 46 on FIG. 5, the output 48 is shown in FIG. 6*b*. In FIGS. 6, *c* through *f*, the time scale has been enlarged so the effects of the multiple pulses can be better discerned. The pules 32 in 6*c*, is long enough to gate on three pulses from 40 producing the output 48 shown in 6*d*. In 6*e* the voltage 26 from the transformer secondary is shown, with the solid curve depicting what the voltage 26 would be, due to the turn on part of the pulse, but without the turn off part of the pulse. The pulse width of oscillator 40 is adjusted to best cause the turn off time of the pulse which starts the ringing of the tank circuit, to coincide most favorably with the turn on part. The turn off ringing is shown as the dotted line in 6*e*. Thus the amplitudes add up to reinforce each other and with each consecutive pulse at 48 produce the maximum signal amplitudes shown in 6*f*. This example is for three pulses 48, but would be similar for any number more than one. Note that after the last pulse, at about at 1.0 msec, the last of the addition of these signals occurs giving a maximum at 37, and thereafter, the ringing decays away with decreasing amplitude. This signal shown in 6*f* corresponds fairly closely to the acoustic output of the transducer X1.

Figure 7:
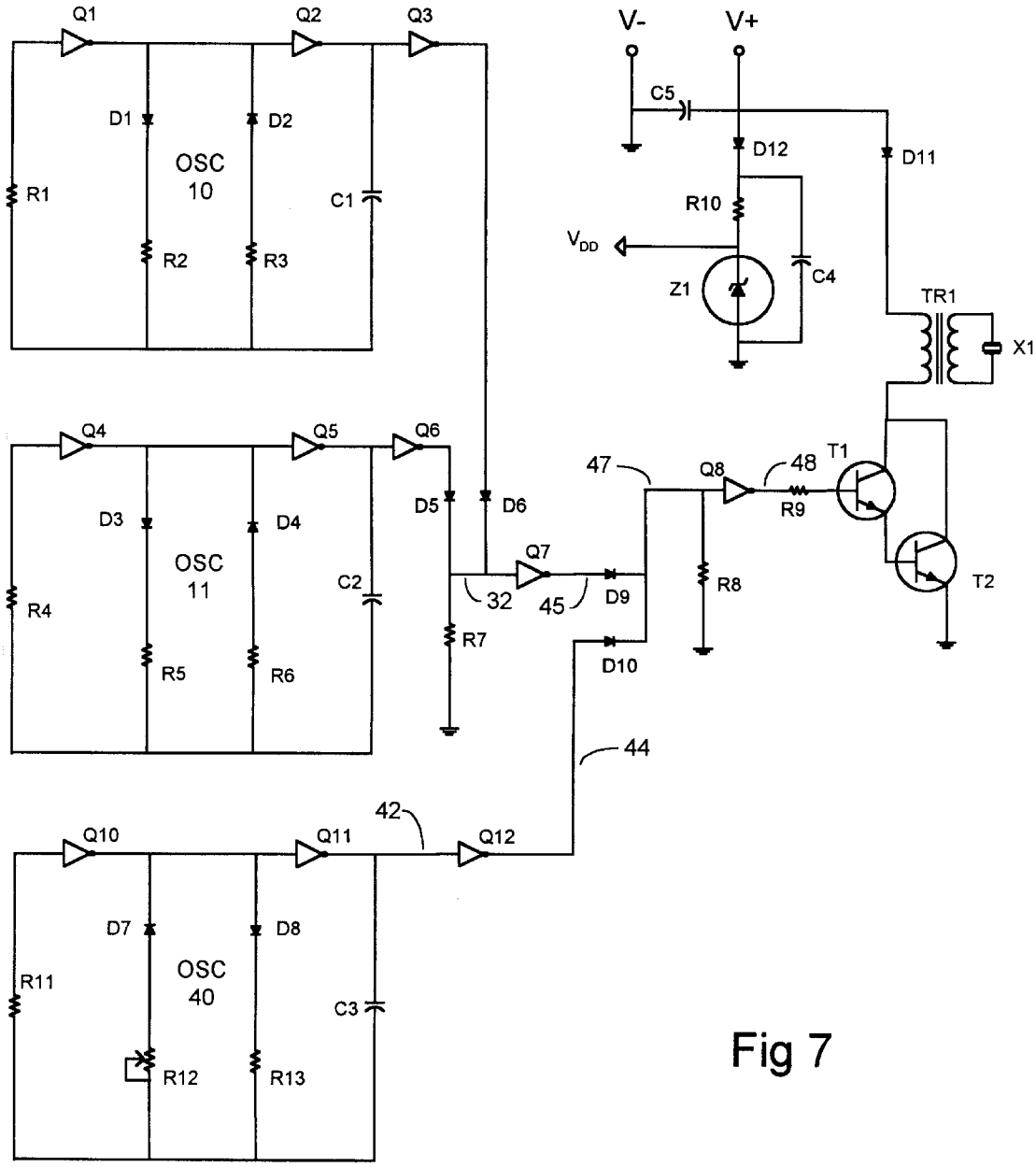
FIG. 7 is a circuit diagram which realizes the functions described by the arrangement of FIG. 5.

In FIG. 7, a practical circuit diagram for realizing one configuration of the arrangement of FIG. 5 is described. There are one or more lower frequency pulse oscillators 10, 11, etc, which are shown in this example to be similar to that described in FIG. 4. Similarly, they are combined at 32 in an "OR" consisting of D5, D6, and R7. The output 32 is then sent to inverter buffer Q7 which provides a low going signal 45 for the lower frequencies. The resonant (higher) frequency pulse oscillator 40 produces a continuous pulse stream of high going pulses at 42, with an optimized pulse width set by R12 and C3. The value of the resistance of R12, which may be a variable resistor, is set to optimize the amplitude of the signal applied to the transducer X1. These signals are now combined in the logical equivalent of the logic AND 46 of FIG. 5, as follows. The signal 42 is sent to inverter Q12, and then the low going pulses at 44 sent to D10, and the signal 45 of lower frequencies from Q7 is applied to D9. The output at 47 will always be high unless both the signals at 44 and 45 are low. This signal at 47 is inverted by Q8 with output at 48, which is shown in FIG. 6*d*, is applied through R9 to T1 and T2 in order to excite the transformer TR1, as previously described for FIG. 4, and thus drives the transducer X1.

Another embodiment of this invention is described in FIG. 8. In this arrangement the signal 48 which may be formed using any number of lower frequencies, and/or frequency modulated or pulsed lower frequency sources 10, 11, is combined with the higher frequency pulse oscillator 40 output 42 in the "AND" 46 and the output 48 is applied to more than one transducer (51, 52, 53) by means of one or more amplifiers 12. These transducers may be arranged in varying spatial relationships with each other in order to make use of the interference of the sound waves so as to control the amplitude of the acoustic radiation in different directions. In this example transducers 51, 52, 53 are arranged in the spatial relationship of a straight line with spacing "a", as depicted in FIG. 9. The angle Theta is the angle between the axis directly forward from the line of transducers and perpendicular to it, and the line of propagation of sound to a point 55.

The value of Theta where the maximum intensity occurs is zero degrees. As one moves away from the forward direction, the angle for which the amplitude is first minimum or zero is given by:

$$\text{Theta}_{MIN}=+/-\text{arc sin}(\tfrac{1}{2}\lambda/a)$$

This amplitude dependence is illustrated by the graph in FIG. 9, and is calculated for an oscillator 40 of 3.2 kHz, and a spacing of d=10 cm between transducers. The amplitude measured at point 55 is plotted as a function of Theta. This shows the primary peak in intensity at 0 degrees and the two minimums 58 at +/−19.5 degrees. Thus most of the sound is focused into a band about 20 degrees (FWHM) wide.

In this example the spatial relationship of the array is one dimensional, but could be built in two dimensions so that the directional effects result in a narrowed acoustic beam angular profile both in the direction illustrated and in the direction perpendicular to it.

Figure 10:
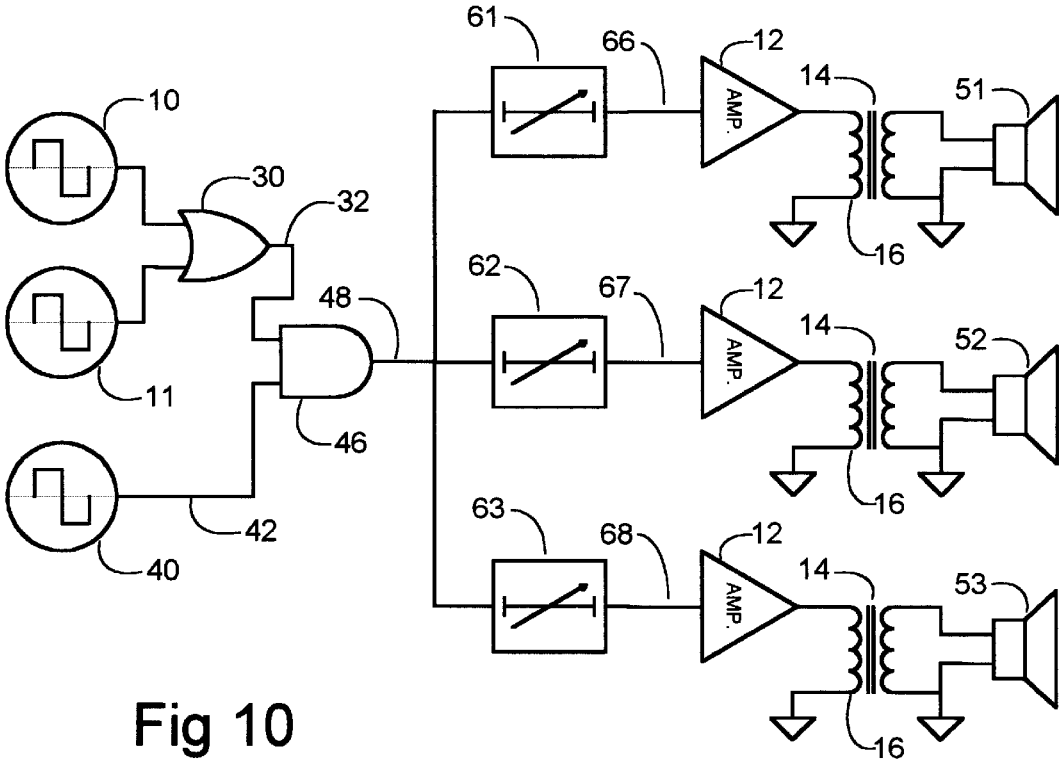
FIG. 10 is a block diagram of another embodiment which uses multiple transducers in accordance with this invention and separate signal delay means in order to electronically control the direction of sound radiation.

In FIG. 10 another embodiment is described in which the signal 48 from one or more lower frequency sources as described before is split into a plurality of signals with each signal being delayed in time by separate signal delay means 61, 62, and 63, in this example. Each of these delayed signals, 66, 67, and 68, is then applied to a separate amplifier and transducer arrangement as before, and the transducers are arranged in a useful spatial relationship.

Figure 11:
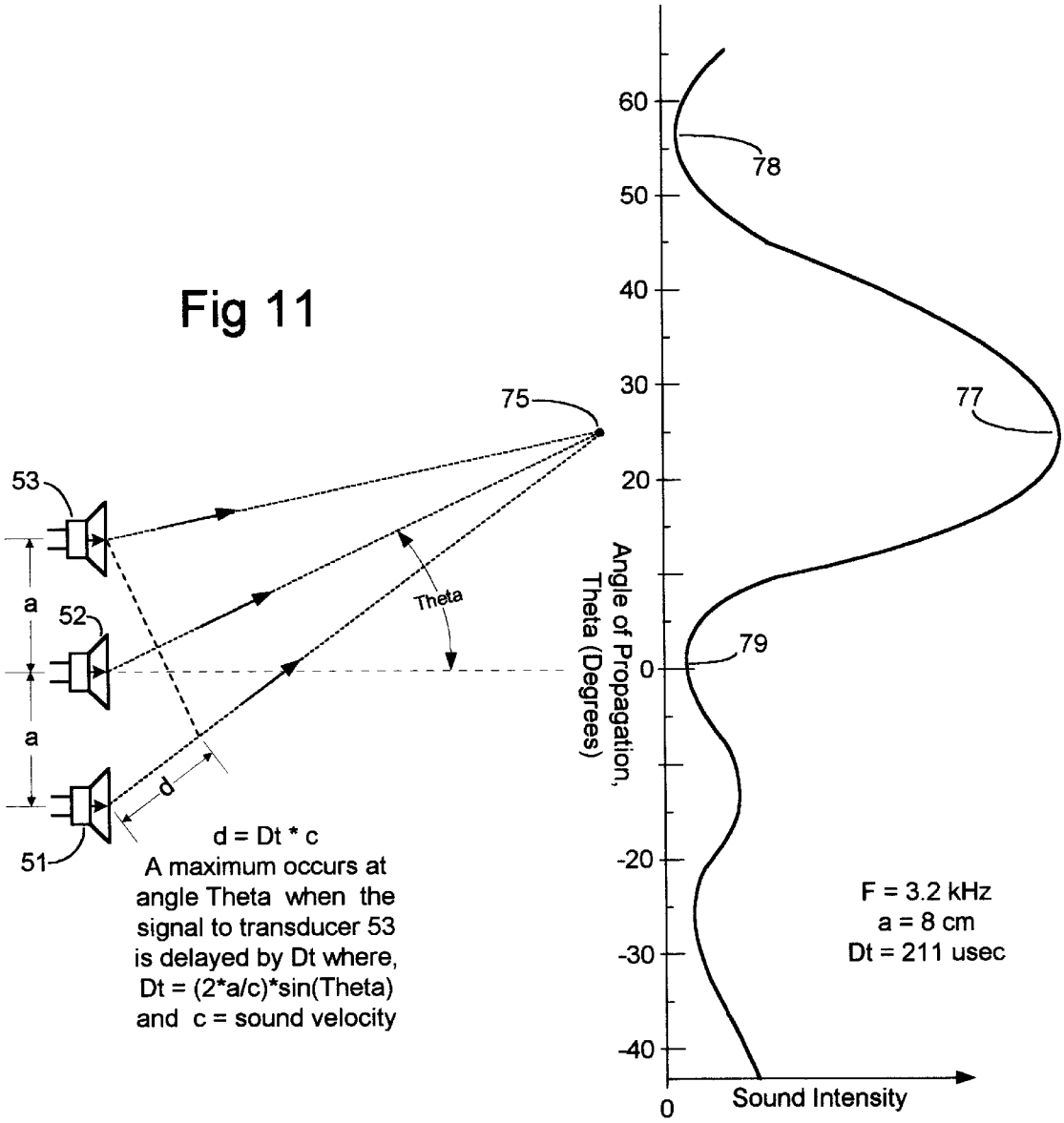
FIG. 11 illustrates an example of the resulting angular distribution for the arrangement of FIG. 10.

An example using three such transducers in a line separated by distance a as shown in FIG. 11. The direction of the maximum amplitude can be controlled by choosing the appropriate delays for each transducer. In this example to produce an amplitude maximum at some angle Theta, the maximum delay $D_T$ for transducer 53 is given by $$D_T=(2*a/c)*\sin(\text{Theta})$$

where c=sound velocity.

The delay in 61 for the first transducer 51 is assumed to be zero, the delay for the last transducer, 53 in this example, is $D_T$ with the transducers in between having linearly proportional delay. The graph in FIG. 11 shows the resulting sound intensity measured at a point 75, as a function of the angle Theta, for the conditions:

spacing a=8 cm,

Resonant frequency=3.2 kHz, and delay $D_T$=211 usec.

The primary peak in amplitude 77 occurs at 25 degrees, and the first minimums 78 and 79 are at 57 and 0.4 degrees. In general the signal delays 61, 62, and 63 could be fixed for some applications or alternatively, electronically varied to produce directional patterns of acoustic radiation that changed dynamically with time. For example the sound beam of an array could be swept back and forth similar to the way an emergency beacon light is rotated, or the beam could be directed at a specific target, without wasting energy in the wrong directions.

What has been described is a novel method and apparatus for improving the efficiency and performance of sounder warning devices.

It is recognized that numerous modifications and changes in the described embodiment of the invention will occur to those skilled in the art without departing from its true spirit and scope. The invention is to be limited only as defined in the claims.

What is claimed is:

1. A sounder device comprising a piezoelectric resonant transducer;

an amplifier means with a coupling transformer means to drive the transducer;

an electronic signal means to provide an input signal to the amplifier means;

with the electronic signal means further comprising
two or more lower frequency pulse oscillators;
a logical "OR" circuit means, with inputs from each of the lower frequency pulse oscillators;
a resonant frequency pulse oscillator means, with a higher frequency near or at the resonant frequency of the transducer, and with a pulse width optimized to produce the maximum acoustic output from the transducer;

a logical "AND" circuit means with a first input connected to the output of the logical "OR" circuit means, a second input connected to the output of the resonant frequency pulse oscillator, and with an output connected to the amplifier input.

2. The sounder device of claim 1 wherein the said electronic signal means comprises a single lower frequency pulse oscillator;

a resonant frequency pulse oscillator means, with a higher frequency near or at the resonant frequency of the transducer, and with a pulse width optimized to produce the maximum acoustic output from the transducer;

a logical "AND" circuit means with a first input connected to the output of the lower frequency pulse oscillator, and a second input connected to the output of the resonant frequency pulse oscillator, and with an output connected to the said amplifier input.

3. The sounder device of claim 1 wherein the said electronic signal means comprises one or more lower frequency pulse oscillators with independent lower audio frequencies and each with a pulse width optimized to produce the maximum acoustic output from the transducer;

a logical "OR" circuit means, with inputs from each of the lower frequency pulse oscillators, and with an output connected to the said amplifier input.

4. The sounder device of claim 1, 2, or 3 wherein the said transducer is a common loudspeaker or similar electromagnetic acoustic transducer.

5. The sounder device of claim 1, 2, or 3 further comprising an oscillator power supply regulating circuit with a diode in series with a capacitor to ground, and in series with a resistor and a zener diode to ground.

6. The sounder device of claim 1, 2, or 3 wherein one or more of the said lower frequency pulse oscillators is made to have a repeatedly rising and or falling frequency producing siren like sound.

7. A sounder device comprising

Two or more piezoelectric resonant transducers, arranged in spatial relationship to each other in order to control the direction and shape of the radiation pattern;

one or more amplifier means with one or more coupling transformer means to drive the transducers;

an electronic signal means to provide an input signal to the amplifier means;

with the electronic signal means further comprising
one or more lower frequency pulse oscillators;
a logical "OR" circuit means, with inputs from each of the lower frequency pulse oscillators;
a resonant frequency pulse oscillator means, with a higher frequency near or at the resonant frequency of the transducer, and with a pulse width optimized to produce the maximum acoustic output from the transducer;

a logical "AND" circuit means with a first input connected to the output of the logical "OR" circuit means, a second input connected to the output of the resonant frequency pulse oscillator, and with an output connected to the input of each of the amplifiers.

8. The sounder device of claim 7 wherein each said transducer is a common loudspeaker or similar electromagnetic acoustic transducer.

9. A sounder device comprising

Two or more piezoelectric resonant transducers, arranged in a spatial relationship to each other in order to control the direction and shape of the radiation pattern;

an equal number of amplifier means with a similar number of coupling transformer means to drive the transducers;

a number of signal delay means, which may have preset or adjustable delay times up to the period corresponding to the resonant frequency of the transducers, said delay means placed in series with the signals going to each of the said amplifiers;

an electronic signal means to provide an input signal to the delay means, with the electronic signal means further comprising
one or more lower frequency pulse oscillators;
a logical "OR" circuit means, with inputs from each of the lower frequency pulse oscillators;
a resonant frequency pulse oscillator means, with a higher frequency near or at the resonant frequency of the transducer, and with a pulse width optimized to produce the maximum acoustic output from the transducer;
a logical "AND" circuit means with a first input connected to the output of the logical "OR" circuit means, a second input connected to the output of the resonant frequency pulse oscillator, and with an output connected to the input of each of the amplifiers.

10. The sounder device of claim 9 wherein the delay times of the said delay circuit means can be varied or adjusted electronically in order to actively control the acoustic radiation direction.

11. The sounder device of claim 9 or 10 wherein each said transducer is a common loudspeaker or similar electromagnetic acoustic transducer.

* * * * *